US006090749A

United States Patent [19]

Kowalski

[11] Patent Number: 6,090,749

[45] Date of Patent: Jul. 18, 2000

[54] METHOD FOR APPLYING CLEAR, VIVID, AND WATER-FAST PRINTED IMAGES TO A SUSBTRATE

[75] Inventor: Mark H. Kowalski, Corvallis, Oreg.

[73] Assignee: Hewlett-Packard Company, Palo Alto, Calif.

[21] Appl. No.: 08/829,744

[22] Filed: Mar. 31, 1997

[51] Int. Cl.[7] ..... B41J 2/32; B41M 5/035; B41M 5/20

[52] U.S. Cl. ..... 503/227; 347/105

[58] Field of Search ..... 347/102, 221, 347/51, 105; 503/227; 8/471

[56] References Cited

U.S. PATENT DOCUMENTS

| | | | |
|---|---|---|---|
| 4,021,591 | 5/1977 | DeVries et al. | 8/468 |
| 4,058,644 | 11/1977 | DeVries et al. | 428/200 |
| 4,292,103 | 9/1981 | Namura et al. | 156/230 |
| 4,294,641 | 10/1981 | Reed et al. | 156/234 |
| 4,329,698 | 5/1982 | Smith | 347/68 |
| 4,455,147 | 6/1984 | Lewis et al. | 8/471 |
| 4,463,359 | 7/1984 | Ayata et al. | 347/56 |
| 4,486,033 | 12/1984 | Parrotta | 283/94 |
| 4,500,895 | 2/1985 | Buck et al. | 347/87 |
| 4,749,291 | 6/1988 | Kobayashi et al. | 400/124.1 |
| 4,758,952 | 7/1988 | Harris, Jr. et al. | 101/487 |
| 4,771,295 | 9/1988 | Baker et al. | 347/87 |
| 4,773,953 | 9/1988 | Hare | 156/240 |
| 4,775,657 | 10/1988 | Harrison et al. | 503/227 |
| 4,868,581 | 9/1989 | Mouri et al. | 347/105 |
| 4,944,850 | 7/1990 | Dion | 205/125 |
| 4,966,815 | 10/1990 | Hare | 428/497 |
| 4,980,224 | 12/1990 | Hare | 428/202 |
| 5,139,917 | 8/1992 | Hare | 430/138 |
| 5,236,801 | 8/1993 | Hare | 430/199 |
| 5,246,518 | 9/1993 | Hale | 156/230 |
| 5,248,363 | 9/1993 | Hale | 156/230 |
| 5,278,584 | 1/1994 | Keefe et al. . | |
| 5,302,223 | 4/1994 | Hale | 156/230 |
| 5,431,501 | 7/1995 | Hale et al. | 400/120.02 |
| 5,487,614 | 1/1996 | Hale | 101/488 |
| 5,488,907 | 2/1996 | Xu et al. | 101/488 |

FOREIGN PATENT DOCUMENTS

| | | | |
|---|---|---|---|
| 0179737A1 | 9/1985 | European Pat. Off. | C09D 11/10 |
| 0792747 | 7/1996 | European Pat. Off. | B41J 2/17 |
| 2633260B2 | 1/1979 | Germany | B41M 5/26 |
| 2189436 | 10/1987 | United Kingdom . | |

OTHER PUBLICATIONS

*Hewlett–Packard Journal*, vol. 39, No. 4 (Aug. 1988).

*Primary Examiner*—John Barlow
*Assistant Examiner*—Christina Annick

[57] ABSTRACT

A method for producing a clear, vivid and water-fast printed image on a substrate. An ink is used which contains a sublimable dye diffusion thermal transfer coloring agent. The substrate includes a backing layer and an ink absorbent layer on the backing layer. The backing layer is designed to receive the coloring agent therein after sublimation of the coloring agent. The ink is initially delivered to the ink-absorbent layer. The substrate is then heated to cause sublimation of the coloring agent and diffusion of the sublimed coloring agent into the backing layer. Pressure may also be applied during the heating process. In addition, the ink can be retained within an ink cartridge in a printer unit, with the cartridge having at least one ink ejector. Heating of the substrate may then be accomplished by a heating member in the printer unit which contacts the substrate.

3 Claims, 5 Drawing Sheets

METHOD FOR APPLYING CLEAR, VIVID, AND WATER-FAST PRINTED IMAGES TO A SUSBTRATE

BACKGROUND OF THE INVENTION

The present invention generally relates to the production of printed images on a substrate, and more particularly to a high-efficiency process for delivering printed images to a substrate which are clear, vivid, and water-fast.

In recent years, many different substrates (e.g. "print media materials") have been developed for a wide variety of applications. These substrates were specifically designed for use with high-definition printing systems that are capable of delivering monochromatic or multi-colored images in a rapid manner. Thermal inkjet systems are especially important in this regard. Printing systems using thermal inkjet technology basically involve a cartridge which includes at least one ink reservoir chamber in fluid communication with a printhead having a plurality of resistors therein. Selective activation of the resistors causes thermal excitation of the ink and expulsion of the ink from the cartridge. Representative thermal inkjet systems are discussed in U.S. Pat. No. 4,500,895 to Buck et al.; U.S. Pat. No. 4,771,295 to Baker et al.; U.S. Pat. No. 5,278,584 to Keefe et al.; and the *Hewlett-Packard Journal,* Vol. 39, No. 4 (August 1988), all of which are incorporated herein by reference.

Whether a thermal inkjet printing system or other type of printing apparatus is employed, one substrate of current interest involves a structure which consists of multiple layers affixed together to form a single, integrated unit. Typical substrates of this type normally include (1) a backing layer usually manufactured from one or more organic polymer compositions; and (2) an ink-absorbent layer made from a composition that is specifically designed to retain and absorb ink materials. These substrates are commercially available from a number of sources including the Hewlett-Packard Company of Palo Alto, Calif. (USA) under the product designations C3836A and C3834A. Substrates of this type are currently used for a number of different purposes. These purposes range from the preparation of "transparencies" for overhead projector use to the production of high-quality printed sheets while may be employed for display purposes in many different technical fields.

Regardless of the particular printing method that is selected to deliver ink materials to a multi-layer substrate of the type listed above, a number of important considerations exist which directly relate to the overall quality of the final printed image. The printed image must be vivid (particularly if multi-color designs are involved) and clear with a high level of definition. The word "vivid" (which is also known as "high-chroma") specifically involves a situation in which the printed image (comprised of one or more colors) is bright, crisp, and clearly defined from one color region to another. In addition, of primary importance is another factor which greatly influences the overall print quality and stability of the final printed product. Specifically, the printed image on the substrate must be water-fast. The term "water-fast" as used herein shall signify a printed image which does not smear, bleed, run, or fade when exposed to moisture (e.g. water and/or water-based materials). If the printed image on the substrate is not sufficiently water-fast it will become distorted, indistinct, and unclear during and after contact with moisture. The production of water-fast images is therefore of considerable importance in all types of printing systems including those which use thermal inkjet technology.

Prior to development of the present invention, a need existed for materials and processes which were capable of producing clear, vivid, and water-fast printed images on a substrate of the type listed above (e.g. which includes a polymeric backing layer and an ink-absorbent layer positioned on the backing layer). A need also remained for a system in which these benefits could be achieved using many different printing systems, including those which incorporate thermal inkjet technology. The present invention satisfies this need in a unique and effective manner which enables the creation of clear, vivid, and water-fast printed images on the multi-layer substrates of primary interest as discussed above. Likewise, the claimed invention is especially appropriate for use in connection with thermal inkjet systems and other printing methods in which ink materials are dispensed from a cartridge unit having one or more self-contained ink ejectors therein. Accordingly, as discussed in considerable detail below, the claimed invention represents an important advance in printing technology and satisfies a number of long-felt needs.

SUMMARY OF THE INVENTION

It is an object of the present invention to provide an improved process for applying printed images to a substrate.

It is another object of the invention to provide an improved process for applying printed images to a substrate which is suitable for use with many different printing systems and technologies.

It is another object of the invention to provide an improved process for applying printed images to a substrate which is especially appropriate for use with thermal inkjet printing systems.

It is another object of the invention to provide an improved process for applying printed images to a substrate in which a multi-layer substrate is used which includes (1) a backing layer; and (2) an ink-absorbent layer on the backing layer, with the final printed images being clear, vivid, and highly water-fast.

It is another object of the invention to provide an improved process for applying printed images to a substrate of the type listed above which uses a minimal number of process steps and materials to deliver the desired printed images to the substrate.

It is a further object of the invention to provide an improved process for applying printed images to a substrate of the type described above in which complex, multi-color designs may be delivered with a high degree of resolution and stability.

It is a still further object of the invention to provide an improved process for applying printed images to a substrate of the type discussed above which employs special ink compositions (e.g. coloring agents) to provide enhanced stability.

It is an even further object of the invention to provide an improved process for applying printed images to a substrate of the type described above which generally involves a minimal level of complexity and is suitable for use by both commercial users and consumers on an in-home basis.

In accordance with the present invention, a highly efficient method is provided for applying clear, vivid, and stable printed images to a selected substrate using thermal inkjet systems and other printing technologies. The claimed process is specifically directed to substrate materials of a multi-layer character which include (1) a backing layer [typically produced from an organic film-type polymer]; and (2) an ink absorbent layer positioned on the backing layer. Many different compositions may be employed in connection with the substrate and its various layers as discussed further below. Accordingly, the claimed process shall not be restricted to any particular materials which are used to produce the substrate. The following discussion represents a brief summary of the claimed invention. More specific and comprehensive information will be provided below in the Detailed Description of Preferred Embodiments section. It should be also be noted that while the present invention shall be discussed herein with primary reference to thermal inkjet technology, it is likewise applicable to other ink delivery systems. In particular, the invention may be used in connection with any type of ink printing system which involves an ink cartridge having a printhead containing one or more ink ejection devices ("ink ejectors") therein. Thus, the claimed invention shall not be restricted to any particular type of ink transfer technology.

To produce a clear, vivid (e.g. brightly colored or "high chroma"), and water-fast printed image in accordance with the invention, a specialized ink composition is initially provided which includes an ink vehicle (e.g. water and preferably one or more solvent materials as discussed in detail below) and a coloring agent designated herein as a "sublimable dye diffusion thermal transfer coloring agent". The term "dye diffusion thermal transfer coloring agent" is defined herein to involve a particular and unique class of chemical colorants which are (1) substantially insoluble in water; (2) completely or partially soluble in organic solvents; and (3) sublimable at temperatures as low as about 200° C. This particular colorant is particularly useful in accordance with its unique ability to diffuse directly into the backing layer of the substrate being employed in the claimed process (discussed further below). However, the present invention shall not be restricted to any particular sublimable dye diffusion thermal transfer coloring agents, with multiple examples and commercial sources for these materials being presented below. Likewise, the claimed ink composition shall not be limited to the incorporation of any other ingredients therein, with a number of additional additives and supplemental compounds being further discussed in the Detailed Description of Preferred Embodiments section below.

A multi-layer image-receiving substrate is then selected which again includes (1) a backing layer; and (2) an ink absorbent layer positioned on the backing layer. The substrate also has a top surface and a bottom surface. The backing layer is specifically comprised of a composition (e.g. an organic polymer) that will enable the sublimable dye diffusion thermal transfer coloring agent in the ink composition to pass directly into the interior region of the backing layer during sublimation of the coloring agent. The backing layer is also designed to provide structural support for the entire substrate. Further details regarding the various materials which may be employed in the multiple layers of the substrate will also be presented below.

Next, the ink composition is delivered to the ink absorbent layer of the image-receiving substrate (e.g. using thermal inkjet technology or other ink delivery processes). As a result, at least part or preferably all of the ink composition is absorbed into the interior region of the ink absorbent layer. Whether the ink composition is entirely absorbed in the ink absorbent layer or only partially absorbed (with some of the ink being adsorbed onto the surface of the ink absorbent layer), both of these interactions between the ink composition and the ink absorbent layer shall be considered equivalent in function, purpose, and final result.

After or during the ink delivery process discussed above, the image-receiving substrate is heated to a temperature sufficient to cause (1) sublimation of the sublimable dye diffusion thermal transfer coloring agent in the ink composition; and (2) diffusion (e.g. migration) of the sublimed coloring agent from the ink absorbent layer directly into the interior region of the backing layer so that the coloring agent is retained and affixed therein. In particular, heating of the image-receiving substrate in this manner causes diffusion of the coloring agent through the ink absorbent layer of the substrate, following by transfer of the coloring agent directly into the underlying backing layer. In a preferred and non-limiting embodiment, this step of the claimed process is achieved by heating the substrate to a temperature of about 180–220° C. over a time period of about 5–30 seconds. However, these parameters may again be varied as needed in accordance with the particular ink composition being employed and the specific materials associated with the substrate as determined by routine preliminary investigation. It should also be noted that, in an optimum and preferred embodiment which represents an additional departure from prior systems, the top surface of the image-receiving substrate (e.g. the upper surface of the ink absorbent layer as discussed below) is physically unattached to any other layers of material during the application of heat to the substrate. In particular, the top surface of the image-receiving substrate is not coated with any additional layers of material, with the lack of such a "coating" or covering material involving a situation in which the top surface of the substrate does not have any additional materials attached thereto by physical, chemical, or electrostatic means. This qualification does not include temporary cover members or sheets which are not "attached" to the substrate but merely placed in position on the substrate for a short time period and then removed for a variety of purposes including a reduction in cleaning and maintenance requirements associated with the heating apparatus.

As a result of the foregoing step (e.g. the application of heat to the substrate as indicated above), a stable, vivid, ("high chroma"), and water-fast printed image is generated from the ink composition in a rapid and effective manner with a high level of stability which represents an advance in the art of printing technology. The printed image is retained within the interior region of the backing layer of the substrate which contributes to its high level of stability and water-fastness.

Regarding the particular methods which may be employed to heat the substrate as discussed above, a number of different heating systems can be used for this purpose ranging from conventional heat press units to infra-red devices. In an additional non-limiting embodiment (which is particularly appropriate when heat press systems are employed), pressure may optionally be applied to the substrate (e.g. during heating) to further enhance the dye diffusion/affixation process. Efficient results are achieved when a representative pressure range of about 3–40 psi is uniformly applied to the substrate during heating (e.g. within a conventional heat press apparatus as noted above). However, the need to apply pressure in the claimed process (as well as the particular pressure levels of interest) may again be determined in accordance with preliminary pilot studies on the materials and ink compositions being processed.

Finally, while the claimed method shall not be restricted to any particular ink delivery method, one alternative method of interest involves the use of a printing apparatus having at least one ink cartridge therein, with the ink cartridge comprising a housing and a printhead affixed to the housing. The printhead in this embodiment further includes at least one ink ejector for delivering ink materials from the ink cartridge to the substrate. The housing of the ink cartridge contains a supply of at least one ink composition, with the ink composition having the ingredients listed above (including a vehicle and at least one sublimable dye diffusion thermal transfer coloring agent). A representative, preferred, and non-limiting apparatus which may be employed for this purpose involves a thermal inkjet printer unit and cartridge(s) of the type discussed in U.S. Pat. No. 4,500,895 to Buck et al.; U.S. Pat. No. 4,771,295 to Baker et al.; U.S. Pat. No. 5,278,584 to Keefe et al.; and the *Hewlett-Packard Journal,* Vol. 39, No. 4 (August 1988), all of which are incorporated herein by reference as noted above. However, other systems which use different printing technology but nonetheless involve an ink containment vessel having a printhead with at least one ink ejector therein are also applicable in the claimed process. All of the other parameters discussed above in connection with the primary embodiment of the present invention including heating, pressurization, and time factors are equally applicable to this embodiment of the invention (which involves the use of thermal inkjet technology or other comparable printing systems) unless otherwise indicated herein.

Once the desired cartridge-type printing system and image-receiving substrate are obtained (with the substrate again including a backing layer and an ink-absorbent layer), the substrate is placed within the printer unit. The ink ejector system of the printhead in the ink cartridge is then activated in order to deliver the ink composition from the ink cartridge to the ink absorbent layer of the substrate (e.g. onto the top surface of the substrate). Next, as discussed above, the substrate is heated to a temperature sufficient to cause sublimation of the coloring agent and diffusion of the coloring agent through the ink absorbent layer into the backing layer. In a preferred and non-limiting embodiment, this step is again achieved by heating the substrate to a temperature of about 180–220° C. over a time period of about 5–30 seconds. However, these parameters may again be varied as needed in accordance with the particular ink composition being employed and the specific materials used to produce the substrate as determined by routine preliminary testing.

As noted above in the primary embodiment of the invention, the top surface of the image-receiving substrate (e.g. the upper surface of the ink absorbent layer) is preferably unattached to any other layers of material during the application of heat. Specifically, the top surface of the substrate is not coated with any additional layers of material, with the lack of such a "coating" or covering composition involving a situation in which the top surface of the substrate does not have any additional materials attached thereto by physical, chemical, or electrostatic means. This qualification excludes temporary cover members or sheets which are not "attached" to the substrate but merely placed in position thereon for a minimal time period and then removed for a variety of purposes including a reduction in cleaning and maintenance requirements associated with the heating apparatus. In accordance with this alternative process, a stable, vivid, and water-fast printed image is produced in a rapid and effective manner.

Regarding the particular methods which may be selected to heat the substrate when the alternative ink delivery method of this embodiment is employed, many different heating systems can be used ranging from conventional heat press units to infra-red heating devices. However, in a still further alternative embodiment of the invention which includes all of the features and parameters listed above, the selected printer unit will include at least one heating member (e.g. one or more heated "pinch"-type rollers, platens, rods, bars, panels, and the like) as discussed in greater detail below. To heat the substrate during or after ink delivery in this alternative embodiment, the substrate is placed in direct physical contact with the heating member of the printing apparatus. As a result, the heating member will deliver heat to the substrate in an amount sufficient to cause sublimation of the coloring agent and diffusion thereof into the backing layer of the substrate at the optimum temperature levels listed above. Operation of the heating member and printer unit may be adjusted as needed to ensure that sufficient heating occurs for the necessary amount of time during the claimed process. By placing the substrate in direct contact with the heating member in this manner, a stable, vivid, and water-fast printed image is produced from the ink composition.

When a cartridge-type printing system is used to deliver the ink compositions discussed above, pressure may again be applied to the substrate (optimally during heating) in order to further enhance the dye diffusion/affixation process. Efficient results are achieved when a representative pressure range of about 3–40 psi is uniformly applied to the substrate during heating (e.g. within a conventional heat press system or other comparable apparatus). However, the need to exert pressure on the substrate (as well as the particular pressure levels of interest) may again be determined in accordance with preliminary pilot studies on the materials being processed. Likewise, if pressure is to be applied to the substrate, this step may be accomplished using external pressure-generating systems (e.g. heat presses) which are especially appropriate when heating of the substrate occurs outside of the printer unit. If an internal heating system is employed within the printer unit which involves the use of one or more heating members as described above, the heating members may also be used to apply pressure to the substrate during heat delivery. This process can be accomplished in many ways including the use of heated "pinch"-type rollers or a spring-biasing mechanism associated with the heating member which urges it downwardly against the substrate during heat delivery. Regardless of which method or embodiment is employed, the heating process described above in combination with an ink containing one or more sublimable dye diffusion thermal transfer coloring agents will produce high-quality printed images in a rapid and effective manner.

The present invention represents an advance in the art of printing technology which provides numerous benefits and advantages including: (1) the rapid printing of clear and vivid ("high chroma") images with a minimal amount of equipment and processing steps; (2) enhanced image water-fastness and stability; (3) a minimal level of complexity and required equipment which facilitates at-home use by consumers; (4) the ability to use thermal inkjet technology (or other comparable systems) to generate high-resolution multi-color images which are characterized by improved stability levels; and (5) the ability to accomplish these goals using low-cost materials and equipment. These and other objects, features, and advantages of the invention will be discussed below in the following Brief Description of the Drawings and Detailed Description of Preferred Embodiments.

DETAILED DESCRIPTION OF PREFERRED EMBODIMENTS

Figure 1:
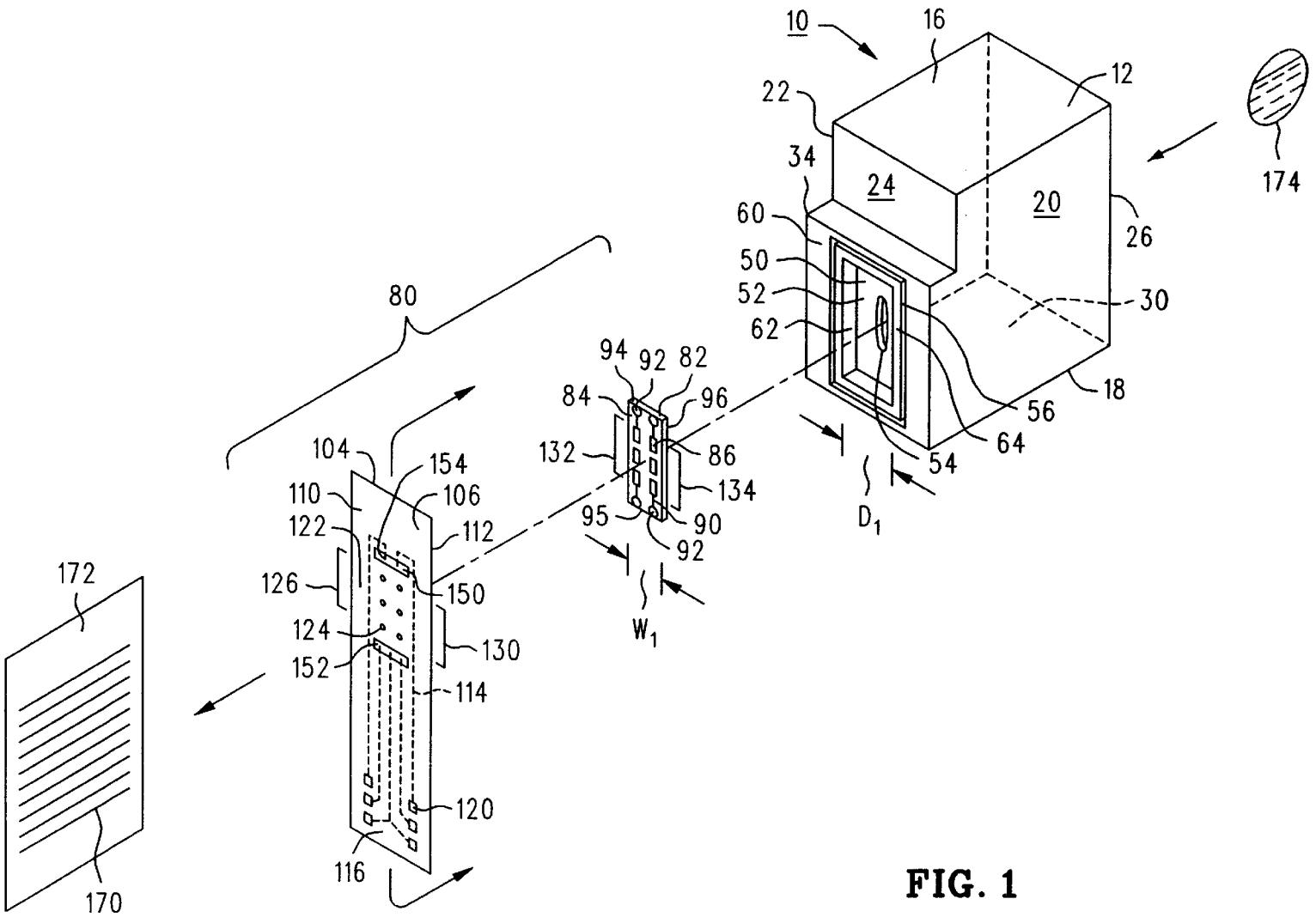
FIG. 1 is a schematic illustration of a representative thermal inkjet cartridge unit which is suitable for use in the process of the present invention.

The present invention involves a unique and highly-effective method for delivering clear, vivid (e.g. "high-chroma"), and water-fast printed images to a selected substrate. A multi-layer substrate is used in the claimed process which includes (1) a specialized backing layer having a number of important characteristics as listed below; and (2) an ink absorbent layer positioned on the backing layer. The terms "vivid" or "high-chroma" basically involve images that are characterized by a high level of brightness, clarity and color-depth when single or multi-color designs are involved. Likewise, as previously noted, the word "water-fast" as used herein involves a printed image which does not smear, bleed, run, or fade when exposed to moisture (e.g. water and/or water-based materials). If the printed image on the substrate is not sufficiently water-fast, it will become distorted, indistinct, and unclear during and after contact with moisture. Thus, the production of water-fast images is of considerable importance in thermal inkjet printing units and other systems using different ink transfer technology. It should also be noted that all of the benefits listed above are equally applicable to both mono-chromatic (one color) images and multi-color printed designs. Regardless of the particular type and color characteristics of the ink compositions employed in the present invention, the claimed process represents a significant advance in printing technology which will become readily apparent from the discussion provided below. The description of this invention will be divided into various sections for the sake of clarity and ease of understanding. These sections include (1) An Overview of Thermal Inkjet Technology; (2) Image-Receiving Substrates Used in the Present Invention; (3) The Ink Compositions of Interest; and (4) The Image Printing Process.

A. An Overview of Thermal Inkjet Technology

As noted above, the present invention is applicable to a wide variety of different ink printing systems. However, of primary interest in this case are printing systems which employ one or more ink-containing cartridge units. Each cartridge specifically includes a printhead which has (1) an upper plate member comprising one or more openings therethrough; and (2) a support member beneath the plate having at least one or more ink "ejectors" positioned on the support member. The term "ink ejector" shall be defined to encompass any type of component or system which selectively ejects or expels ink materials from the printhead. Thermal inkjet printing systems which use multiple heating resistors as ink ejectors are preferred for this purpose and are used with optimum results in the claimed method. However, as previously noted, this invention shall not be restricted to any particular type of ink ejector system or printing technology. Instead, a number of different ink delivery devices may be used including but not limited to piezoelectric drop systems of the general type disclosed in U.S. Pat. No. 4,329,698 to Smith, dot matrix systems of the variety described in U.S. Pat. No. 4,749,291 to Kobayashi et al., as well as other comparable and functionally equivalent systems designed to deliver ink using one or more ink ejectors. The specific ink-expulsion devices associated with these alternative systems (e.g. the piezoelectric elements in the apparatus of U.S. Pat. No. 4,329,698) shall be encompassed within the term "ink ejectors" as noted above. Thus, even though the present invention will be discussed herein with primary reference to thermal inkjet technology, it shall be understood that other systems are equally applicable and relevant to the claimed technology.

To facilitate a complete understanding of the present invention as it applies to thermal inkjet technology (which is the preferred system of primary interest), an overview of thermal inkjet technology will now be provided. It is important to emphasize that the claimed invention shall not be restricted to any particular type of thermal inkjet cartridge unit. Many different cartridge systems may be employed for the purposes described herein. In this regard, the invention shall be prospectively applicable to any type of thermal inkjet system which uses a plurality of thin-film heating resistors mounted on a support member as "ink ejectors" to selectively deliver ink materials, with the ink materials passing through an orifice plate having multiple openings therein. The ink delivery systems schematically shown in the drawing figures listed above are provided for example purposes only and are non-limiting.

With reference to FIG. 1, a representative thermal inkjet ink cartridge 10 is illustrated. This cartridge is of a general type shown and described in U.S. Pat. No. 5,278,584 to Keefe et al. and the *Hewlett-Packard Journal,* Vol. 39, No. 4 (August 1988), both of which are incorporated herein by reference. It is again emphasized that cartridge 10 is presented in schematic format, with more detailed information involving this product being provided in U.S. Pat. No. 5,278,584. As illustrated in FIG. 1, the cartridge 10 first includes a housing 12 which is preferably manufactured from plastic, metal, or a combination of both. The housing 12 further comprises a top wall 16, a bottom wall 18, a first side wall 20, and a second side wall 22. In the embodiment of FIG. 1, the top wall 16 and the bottom wall 18 are substantially parallel to each other. Likewise, the first side wall 20 and the second side wall 22 are also substantially parallel to each other.

The housing 12 likewise includes a front wall 24 and a rear wall 26. Surrounded by the front wall 24, top wall 16, bottom wall 18, first side wall 20, second side wall 22, and rear wall 26 is an interior chamber or compartment 30 within the housing 12 (shown in phantom lines in FIG. 1) which is designed to retain a supply of ink therein as discussed below. The front wall 24 further includes an externally-positioned, outwardly-extending printhead support structure 34 which comprises a substantially rectangular central cavity 50 therein. The central cavity 50 includes a bottom wall 52 shown in FIG. 1 with an ink outlet port 54 therein. The ink outlet port 54 passes entirely through the housing 12 and, as a result, communicates with the compartment 30 inside the housing 12 so that ink materials can flow outwardly from the compartment 30 through the ink outlet port 54.

Also positioned within the central cavity 50 is a rectangular, upwardly-extending mounting frame 56, the function of which will be discussed below. As schematically shown in FIG. 1, the mounting frame 56 is substantially even (flush) with the front face 60 of the printhead support structure 34. The mounting frame 56 specifically includes dual, elongate side walls 62, 64 which will likewise be described in greater detail below.

With continued reference to FIG. 1, fixedly secured to housing 12 of the ink cartridge unit 10 (e.g. attached to the outwardly-extending printhead support structure 34) is a printhead generally designated in FIG. 1 at reference number 80. For the purposes of this invention and in accordance with conventional terminology, the printhead 80 actually comprises two main components secured together (with certain sub-components positioned therebetween). These components and additional information concerning the printhead 80 are provided in U.S. Pat. No. 5,278,584 to Keefe et al. which again discusses the ink cartridge 10 in considerable detail and is incorporated herein by reference. The first main component used to produce the printhead 80 consists of a plate-like support member 82 preferably manufactured from silicon. Secured to the upper surface 84 of the support member 82 using conventional thin film fabrication techniques is a plurality of individually-energizable thin-film resistors 86 which function as "ink ejectors" and are preferably made from a tantalum-aluminum composition known in the art for resistor fabrication. Only a small number of resistors 86 are shown in the schematic representation of FIG. 1, with the resistors 86 being presented in enlarged format for the sake of clarity. Also provided on the upper surface 84 of the support member 82 using conventional photolithographic techniques is a plurality of metallic conductive traces 90 which electrically communicate with the resistors 86. The conductive traces 90 also communicate with multiple metallic pad-like contact regions 92 positioned at the ends 94, 95 of the support member 82 on the upper surface 84. The function of all these components which, in combination, are collectively designated herein as a resistor assembly 96 will be discussed further below. Many different materials and design configurations may be used to construct the resistor assembly 96, with the present invention not being restricted to any particular elements, materials, and components for this purpose. However, in a preferred, representative, and non-limiting embodiment described in U.S. Pat. No. 5,278,584 to Keefe et al., the resistor assembly 96 will be approximately 0.5 inches long, and will likewise contain 300 resistors 86 thus enabling a resolution of 600 dots per inch ("DPI"). The support member 82 containing the resistors 86 thereon will preferably have a width "$W_1$" (FIG. 1) which is less than the distance "$D_1$" between the side walls 62, 64 of the mounting frame 56. As a result, ink flow passageways 100, 102 (schematically shown in FIG. 2) are formed on both sides of the support member 82 so that ink flowing from the ink outlet port 54 in the central cavity 50 can ultimately come in contact with the resistors 86. It should also be noted that the support member 82 may include a number of other components thereon (not shown) depending on the type of ink cartridge unit 10 under consideration. For example, the support member 82 may likewise include a plurality of logic transistors for precisely controlling operation of the resistors 86, as well as a "demultiplexer" of conventional configuration as discussed in U.S. Pat. No. 5,278,584. The demultiplexer is used to demultiplex incoming multiplexed signals and thereafter distribute these signals to the various thin film resistors 86. The use of a demultiplexer for this purpose enables a reduction in the complexity and quantity of the circuitry (e.g. contract regions 92 and traces 90) formed on the support member 82. Other features of the support member 82 (e.g. the resistor assembly 96) will be presented below.

Securely affixed to the upper surface 84 of the support member 82 (with a number of intervening material layers therebetween including a barrier layer and an adhesive layer in the conventional design of FIG. 1) is the second main component of the printhead 80. Specifically, an orifice plate 104 is provided as shown in FIG. 1 which is used to distribute the selected ink compositions to a designated print media material including the substrate of the present invention. Prior orifice plate designs involved a rigid plate structure manufactured from an inert metal composition (e.g. gold-plated nickel) which can also be used in the cartridge 10 of FIG. 1. However, recent developments in thermal inkjet technology have resulted in the use of non-metallic, organic polymer films to construct the orifice plate 104. As illustrated in FIG. 1, this type of orifice plate 104 will consist of a flexible film-type member 106 manufactured from a selected non-metallic organic polymer having a uniform thickness of about 1.0–2.0 mil in a representative embodiment. For the purposes of this invention, the term "non-metallic" shall involve a composition which does not contain any elemental metals, metal alloys, or metal amalgams (e.g. metal mixtures). Likewise, the phrase "organic polymer" shall involve a long-chain carbon-containing structure of repeating chemical subunits. A number of different polymeric compositions may be employed for this purpose, with the present invention not being restricted to any particular construction materials. For example, the orifice plate 104 may be manufactured from the following compositions: polytetrafluoroethylene (e.g. Teflon®), polyimide, polymethylmethacrylate, polycarbonate, polyester, polyamide polyethylene-terephthalate, or mixtures thereof. Likewise, a representative commercial organic polymer (e.g. polyimide-based) composition that is suitable for constructing the orifice plate 104 is a product sold under the trademark "KAPTON" by the DuPont Corporation of Wilmington, Del. (USA). As shown in the schematic illustration of FIG. 1, the flexible orifice plate 104 is designed to "wrap around" the outwardly extending printhead support structure 34 in the completed ink cartridge 10.

Figure 2:
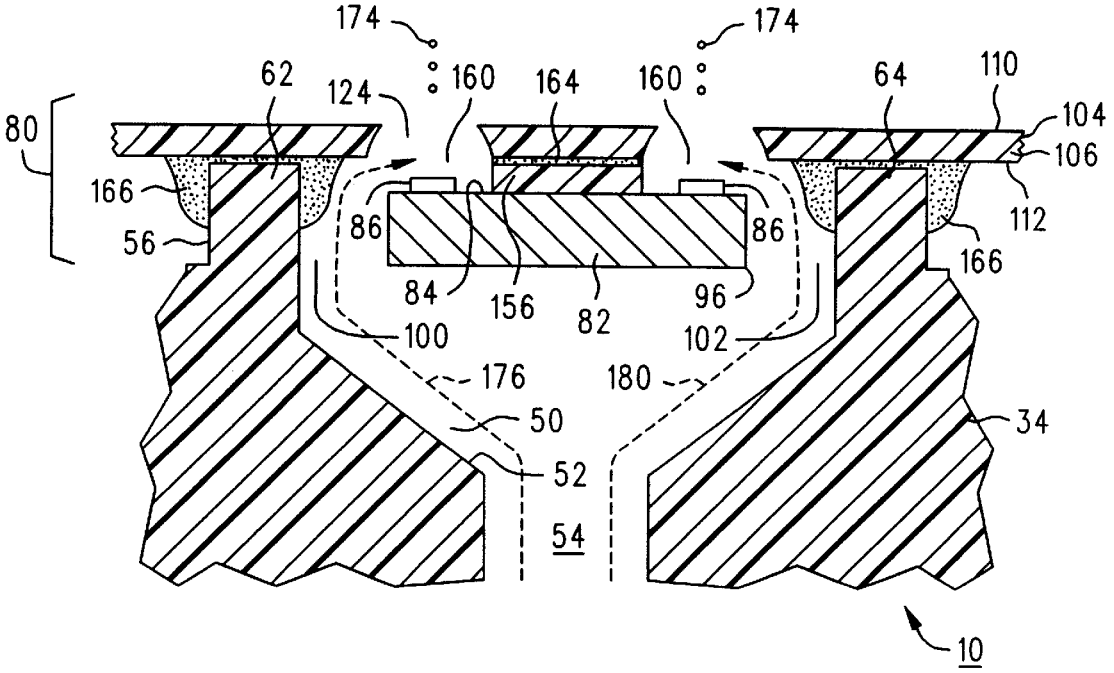
FIG. 2 is a schematic, enlarged cross-sectional view of the printhead associated with the thermal inkjet cartridge unit of FIG. 1.

The film-type member 106 used to produce the orifice plate 104 further includes a top surface 110 and a bottom surface 112 (FIGS. 1 and 2). Formed on the bottom surface 112 of orifice plate 104 and shown in dashed lines in FIG. 1 is a plurality of metallic (e.g. copper) circuit traces 114 which are applied to the bottom surface 112 using known metal deposition and photolithographic techniques. Many different circuit trace patterns may be employed on the bottom surface 112 of the orifice plate 104, with the specific pattern depending on the particular type of ink cartridge unit 10 and printing system under consideration. Also provided at position 116 on the top surface 110 of the orifice plate 104 is a plurality of metallic (e.g. gold-plated copper) contact pads 120. The contact pads 120 communicate with the underlying circuit traces 114 on the bottom surface 112 of the orifice plate 104 using small openings or "vias" (not shown) through the orifice plate 104. During use of the ink cartridge 10 in a printer unit, the pads 120 come in contact with corresponding printer electrodes in order to transmit electrical control signals from the printer unit to the contact pads 120 and circuit traces 114 on the orifice plate 104 for ultimate delivery to the resistor assembly 96. Electrical communication between the resistor assembly 96 and the orifice plate 104 will be discussed below.

Positioned within the middle region 122 of the film-type member 106 used to produce the orifice plate 104 is a plurality of openings or orifices 124 which pass entirely through the orifice plate 104. These orifices 124 are shown in enlarged format in FIG. 1. Each orifice 124 in a representative embodiment will have a diameter of about 0.01–0.05 mm. In the completed printhead 80, all of the components listed above are assembled so that each of the orifices 124 is aligned with at least one of the resistors 86 (e.g. "ink ejectors") on the support member 82. As result, energization of a given resistor 86 will cause ink expulsion from the desired orifice 124 through the orifice plate 104. The claimed invention shall not be limited to any particular size, shape, or dimensional characteristics in connection with the orifice plate 104 and shall likewise not be restricted to any number or arrangement of orifices 124. In a representative embodiment as presented in FIG. 1, the orifices 124 are arranged in two rows 126, 130 on the orifice plate 104. If this arrangement of orifices 124 is employed, the resistors 86 on the resistor assembly 96 (e.g. the support member 82) will also be arranged in two corresponding rows 132, 134 so that the rows 132, 134 of resistors 86 are in substantial registry with the rows 126, 130 of orifices 124.

Finally, as shown in FIG. 1, dual rectangular windows 150, 152 are provided at each end of the rows 126, 130 of orifices 124. Partially positioned within the windows 150, 152 are beam-type leads 154 which, in a representative embodiment, are gold-plated copper and constitute the terminal ends (e.g. the ends opposite the contact pads 120) of the circuit traces 114 positioned on the bottom surface 112 of the orifice plate 104. The leads 154 are designed for electrical connection by soldering, thermocompression bonding, and the like to the contact regions 92 on the upper surface 84 of the support member 82 associated with the resistor assembly 96. Attachment of the leads 154 to the contact regions 92 on the support member 82 is facilitated during mass production manufacturing processes by the windows 150, 152 which enable immediate access to these components. As a result, electrical communication is established from the contact pads 120 to the resistor assembly 96 via the circuit traces 114 on the orifice plate 104. Electrical signals from the printer unit (not shown) can then travel via the conductive traces 90 on the support member 82 to the resistors 86 so that on-demand heating (energization) of the resistors 86 ("ink ejectors") can occur.

At this point, it is important to briefly discuss fabrication techniques in connection with the structures described above which are used to manufacture the printhead 80. Regarding the orifice plate 104, all of the openings therethrough including the windows 150, 152 and the orifices 124 are typically formed using conventional laser ablation techniques as again discussed in U.S. Pat. No. 5,278,584 to Keefe et al. Specifically, a mask structure initially produced using standard lithographic techniques is employed for this purpose. A laser system of conventional design is then chosen which, in a preferred embodiment, involves an excimer laser of a type selected from the following alternatives: $F_2$, ArF, KrCl, KrF, or XeCl. Using this particular system (along with preferred pulse energies of greater than about 100 millijoules/$cm^2$ and pulse durations shorter than about 1 microsecond), the above-listed openings (e.g. orifices 124) can be formed with a high degree of accuracy, precision, and control. However, the claimed invention shall not be limited to any particular fabrication method, with other methods also being suitable for producing the completed orifice plate 104 including conventional ultraviolet ablation processes (e.g. using ultraviolet light in the range of about 150–400 nm), as well as standard chemical etching, stamping, reactive ion etching, ion beam milling, and additional known processes.

After the orifice plate 104 is produced as discussed above, the printhead 80 is completed by attaching the resistor assembly 96 (e.g. the support member 82 having the resistors 86 thereon) to the orifice plate 104. In a preferred embodiment, fabrication of the printhead 80 is accomplished using tape automated bonding ("TAB") technology. The use of this particular process to produce the printhead 80 is again discussed in considerable detail in U.S. Pat. No. 5,278,584. Likewise, background information concerning TAB technology is also generally provided in U.S. Pat. No. 4,944,850 to Dion. In a TAB-based fabrication system, the processed film-type member 106 (e.g. the completed orifice plate 104) which has already been ablated and patterned with the circuit traces 114 and contact pads 120 actually exists in the form of multiple, interconnected "frames" on an elongate "tape", with each "frame" representing one orifice plate 104. The tape (not shown) is thereafter positioned (after cleaning in a conventional manner to remove impurities and other residual materials) in a TAB bonding apparatus having an optical alignment subsystem. Such an apparatus is well-known in the art and commercially available from many different sources including but not limited to the Shinkawa Corporation of Japan (model no. IL-20). Within the TAB bonding apparatus, the support member 82 associated with the resistor assembly 96 and the orifice plate 104 are properly oriented so that (1) the orifices 124 are in precise alignment with the resistors 86 on the support member 82; and (2) the beam-type leads 154 associated with the circuit traces 114 on the orifice plate 104 are in alignment with and positioned against the contact regions 92 on the support member 82. The TAB bonding apparatus then uses a "gang-bonding" method (or other similar procedures) to press the leads 154 onto the contact regions 92 (which is accomplished through the open windows 150, 152 in the orifice plate 104). The TAB bonding apparatus thereafter applies heat in accordance with conventional bonding processes to secure these components together. It is also important to note that other standard bonding techniques may likewise be used for this purpose including but not limited to ultrasonic bonding, conductive epoxy bonding, and solid paste application processes. In this regard, the claimed invention shall not be restricted to any particular processing techniques associated with the printhead 80.

As previously noted in connection with the conventional cartridge unit 10 in FIG. 1, additional layers of material are typically present between the orifice plate 104 and resistor assembly 96. These additional layers perform various functions including electrical insulation, adhesion of the orifice plate 104 to the resistor assembly 96, and the like. With reference to FIG. 2, the printhead 80 is illustrated in cross-section after attachment to the housing 12 of the cartridge unit 10. As illustrated in FIG. 2, the upper surface 84 of the support member 82 likewise includes an intermediate barrier layer 156 thereon which covers the conductive traces 90 (FIG. 1), but is positioned between and around the resistors 86 without covering them. As a result, an ink vaporization chamber 160 (FIG. 2) is formed directly above each resistor 86. Within each chamber 160, ink materials are heated, vaporized, and subsequently expelled through the orifices 124 in the orifice plate 104.

The barrier layer 156 (which is traditionally produced from conventional organic polymers, photoresist materials,, or similar compositions as outlined in U.S. Pat. No. 5,278,584 to Keefe et al.) is applied to the support member 82 using standard photolithographic techniques or other methods known in the art for this purpose. In addition to clearly defining the vaporization chambers 160, the barrier layer 156 also functions as a chemical and electrical insulating layer. Positioned on top of the barrier layer as shown in FIG. 2 is an adhesive layer 164 which may involve a number of different compositions including uncured poly-isoprene photoresist which is applied using conventional photolithographic and other known methods. It is important to note that the use of a separate adhesive layer 164 may, in fact, not be necessary if the top of the barrier layer 156 can be made adhesive in some manner (e.g. if it consists of a material which, when heated, becomes pliable with adhesive characteristics). However, in accordance with the conventional structures and materials shown in FIGS. 1–2, a separate adhesive layer 164 is employed.

During the TAB bonding process discussed above, the printhead 80 (which includes the previously-described components) is ultimately subjected to heat and pressure within a heating/pressure-exerting station in the TAB bonding apparatus. This step (which may likewise be accomplished using other methods including external heating of the printhead 80) causes thermal adhesion of the internal components together (e.g. using the adhesive layer 164 shown in the embodiment of FIG. 2). As a result, the printhead assembly process is completed at this stage.

The only remaining step involves cutting and separating the individual "frames" on the TAB strip (with each "frame" comprising an individual, completed printhead 80), followed by attachment of the printhead 80 to the housing 12 of the ink cartridge unit 10. Attachment of the printhead 80 to the housing 12 may be accomplished in many different ways. However, in a preferred embodiment illustrated schematically in FIG. 2, a portion of adhesive material 166 may be applied to either the mounting frame 56 on the housing 12 and/or selected locations on the bottom surface 112 of the orifice plate 104. The orifice plate 104 is then adhesively affixed to the housing 12 (e.g. on the mounting frame 56 associated with the outwardly-extending printhead support structure 34 shown in FIG. 1). Representative adhesive materials suitable for this purpose include commercially available epoxy resin and cyanoacrylate adhesives known in the art. During the affixation process, the support member 82 associated with the resistor assembly 96 is precisely positioned within the central cavity 50 as illustrated in FIG. 2 so that the support member 82 is located in the center of the mounting frame 56 (discussed above and illustrated in FIG. 1). In this manner, the ink flow passageways 100, 102 (FIG. 2) are formed which enable ink materials to flow from the ink outlet port 54 within the central cavity 50 into the vaporization chambers 160 for expulsion from the cartridge unit 10 through the orifices 124 in the orifice plate 104.

To generate a printed image 170 on a selected image-receiving medium 172 (e.g. the specific multi-layer substrate of the present invention) using the cartridge unit 10, a supply of a selected ink composition 174 (schematically illustrated in FIG. 1) which resides within the interior compartment 30 of the housing 12 passes into and through the ink outlet port 54 within the bottom wall 52 of the central cavity 50. The ink composition 174 (which is specially formulated for use in the claimed process as discussed below) thereafter flows into and through the ink flow passageways 100, 102 in the direction of arrows 176, 180 toward the support member 82 having the resistors 86 thereon (e.g. the resistor assembly 96). The ink composition 174 then enters the vaporization chambers 160 directly above the resistors 86. Within the chambers 160, the ink composition 174 comes in contact with the resistors 86. To activate (e.g. energize) the resistors 86, the printer system (not shown) which contains the cartridge unit 10 causes electrical signals to travel from the printer unit to the contact pads 120 on the top surface 110 of the orifice plate 104. The electrical signals then pass through vias (not shown) within the plate 104 and subsequently travel along the circuit traces 114 on the bottom surface 112 of the plate 104 to the resistor assembly 96 containing the resistors 86. In this manner, the resistors 86 can be selectively energized and heated in order to cause ink vaporization and expulsion from the printhead 80 via the orifices 124 through the orifice plate 104. The ink composition 174 can then be delivered in a highly selective, on-demand basis to the image-receiving medium 172 to generate a printed image 170 thereon (FIG. 1).

It is important to emphasize that the printing process discussed above is applicable to a wide variety of different thermal inkjet cartridge designs. In this regard, the inventive concepts presented below shall not be restricted to any particular printing system. However, a representative, non-limiting example of a thermal inkjet cartridge of the type described above which may be used in connection with the claimed invention involves an inkjet cartridge sold by the Hewlett-Packard Company of Palo Alto, Calif. (USA) under the designation "51645A." Other ink cartridge units produced by the Hewlett-Packard Company which are prospectively applicable in the claimed process include products sold under the following designations: 51641A, 51640C, 51640A, 51629A, and 51649A. Likewise, further details concerning thermal inkjet processes in general are discussed in the *Hewlett-Packard Journal,* Vol. 39, No. 4 (August 1988), U.S. Pat. No. 4,500,895 to Buck et al. and U.S. Pat. No. 4,771,295 to Baker et al. Having described conventional thermal inkjet components and printing methods, the claimed invention and its beneficial features will now be presented.

B. Image-Receiving Substrates Used in the Present Invention

Figure 3:
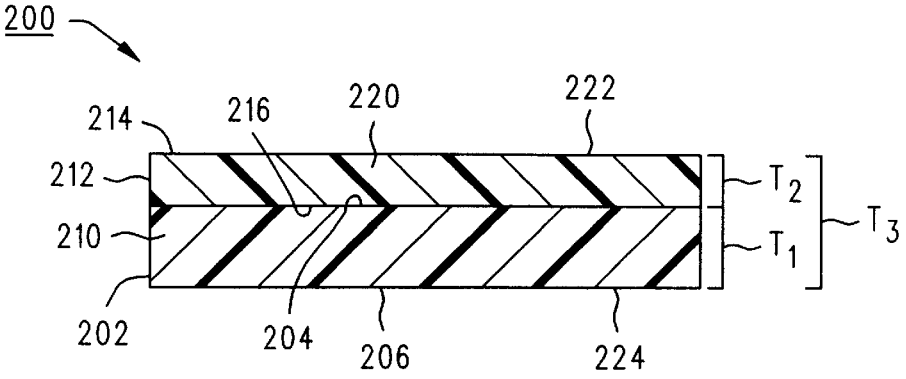
FIG. 3 is a cross-sectional, schematic view of a representative multi-layer substrate which may be employed in the claimed process, with the layers in the substrate being enlarged for the sake of clarity.

With reference to FIG. 3, a specialized multi-layer substrate is provided which is designed to receive the ink compositions described below in order to produce clear, vivid, and water-fast printed images in the claimed process. This particular substrate is illustrated schematically, cross-sectionally, and in enlarged format in FIG. 3 at reference number 200. As shown in FIG. 3, the substrate 200 (which is optimally planar in configuration) first includes a backing layer 202 having an upper surface 204 and a lower surface 206. The backing layer 202 will typically have an average thickness of about 0.002–0.5 inches. The backing layer 202 is specifically designed for two main purposes. First, it is used to impart strength, tear-resistance, and overall support in the completed substrate 200. Second (and of primary importance from a functional standpoint), it is constructed of a material which will allow the specialized coloring agents of the present invention (e.g. "sublimable dye diffusion thermal transfer coloring agents" as discussed in the next section) to pass by diffusion/absorption into the interior region 210 (FIG. 3) of the backing layer 202 (e.g. the area between the upper and lower surfaces 204, 206) during sublimation of the coloring agent(s) in the ink composition. Specifically, the backing layer 202 is made of a specialized material which is capable of receiving (e.g. absorbing) the selected coloring agent within the interior region 210 so that the sublimed coloring agent is immobilized/retained in the backing layer 202. Once the coloring agent has diffused into the interior region 210 of the backing layer 202, it is maintained within the backing layer 202 in a highly stable condition in order to produce a printed image that is clear, vivid, and water-fast (due to entrainment of the coloring agent inside the backing layer 202 as discussed further below.)

A number of different materials having the desired characteristics outlined above may be used to produce the backing layer 202 of the substrate 200, with the present invention not being restricted to any specific materials for this purpose. Representative compositions suitable for use in manufacturing the backing layer 202 which are capable of receiving and retaining the selected coloring agent(s) therein include a number of organic polymer film-type compositions. Specific examples of these compositions are as follows: polyester, polyethylene terephthalate (sold under the trademark MYLAR), polycarbonates, acrylics, and acrylonitrile butadiene styrene terpolymer.

Regardless of which materials are selected for use in the backing layer 202 of the substrate 200, it is preferred that the backing layer 202 have a uniform thickness "$T_1$" (FIG. 3) of about 0.002–0.5 inches as noted above. However, this value may be varied as needed in accordance with preliminary pilot studies involving the particular compositions to be employed in connection with the backing layer 202 and other factors.

Applied directly to the upper surface 204 of the backing layer 202 (FIG. 3) is an ink absorbent layer 212 having an upper surface 214 and a lower surface 216. The ink absorbent layer 212 consists of a composition that is designed to initially absorb (on a partial or total basis) the selected ink composition within the interior region 220 (FIG. 3) of the layer 212 prior to the heating/sublimation stages of the present invention. Accordingly, the composition used to produce the ink absorbent layer 212 should be sufficiently absorptive and chemically compatible to enable the ink composition to be directly absorbed and retained within the layer 212 until the subsequent stages of the claimed process are completed. While the present invention shall not be limited to any particular compounds in connection with the ink absorbent layer 212, representative materials suitable for this purpose will be (1) sufficiently porous and permeable to enable the absorbed coloring agents to diffuse through the ink absorbent layer 212 and into the interior region 210 of the backing layer 202 during sublimation of the coloring agents; and (2) substantially colorless (e.g. transparent) in order to enable the coloring agents (e.g. the printed image) within the backing layer 202 to be readily visible. Representative materials which may be employed to produce the ink absorbent layer 212 having the characteristics listed above include polyvinyl alcohol, polyacrylamide, polyvinyl acetate, polyvinyl pyrrolidone, polyvinylidene chloride, polyacrylate, and methyl cellulose. Regardless of which materials are selected for use as the ink absorbent layer 212 of the substrate 200, it is preferred that the ink absorbent layer 212 have a uniform thickness "$T_2$" (FIG. 3) of about 0.0005–0.002 inches with an overall "coating weight" on the backing layer 202 of about 1–10 g/m$^2$. However, these values may likewise be varied as needed in accordance with preliminary pilot studies involving the particular compositions to be employed in connection with the ink absorbent layer 212 and other factors.

The completed substrate 200 shown in FIG. 3 will have an overall uniform thickness "$T_3$" in a preferred and non-limiting embodiment of about 0.0025–0.502 inches. Likewise, the substrate 200 will include a top surface 222 (which also functions as the upper surface 214 of the ink absorbent layer 212) and a bottom surface 224 (which also constitutes the lower surface 206 of the backing layer 202.) The substrate 200 should be sufficiently flexible to enable insertion of the substrate 200 within a selected printing apparatus (discussed below), with this level of flexibility being accomplished through the use of a completed product having the thickness values and other parameters listed above.

The substrate 200 described herein and illustrated in FIG. 3 is commercially available from numerous sources including the Hewlett-Packard Company of Palo Alto, Calif. (USA)—[product numbers/designations C3836A and C3834A]. As discussed below, the substrate 200 is used in connection with the special ink formulations listed in the next section which are capable of initial (e.g. temporary) absorption into the ink absorbent layer 212, followed by diffusion into the interior region 210 of the backing layer 202 when the coloring agents in the ink composition are sublimed. The ink compositions and coloring agents which may be employed for this purpose will now be described in detail.

C. The Ink Compositions of Interest

Many different ink formulations may be used with the substrate 200 and claimed printing process. Accordingly, the present invention shall not be restricted to the generation of printed images using any particular ink product. However, at a minimum, the selected ink composition will include an ink vehicle and at least one coloring agent, with the term "coloring agent" being defined to encompass a wide variety of different dye materials and pigments (including black and many other colors.) Regarding the particular coloring agent to be employed, a preferred composition suitable for this purpose will consist of a material designated as a "sublimable dye diffusion thermal transfer coloring agent" which is otherwise designated in abbreviated form as a "D2T2" coloring agent. The term "sublimable dye diffusion thermal transfer coloring agent" involves a particular class of chemical colorants which, in general, are (1) substantially insoluble in water; (2) completely or partially soluble in organic solvents; and (3) sublimable at temperatures as low as about 200° C. which, in the unique process of the present invention, enables them to be readily diffused into the interior region 210 of the backing layer 202 of substrate 200. The term "sublime" or "sublimation" involves a situation in which a solid material changes directly into a vapor phase without conversion into any intermediate phases (e.g. liquid states).

All of the sublimable dye diffusion thermal transfer coloring agents of the claimed process basically involve "dispersions" in which micro-particulate dye solids are essentially suspended within a dispersant system preferably containing water and a selected liquid or solid chemical dispersing agent. Many different commercially-available sublimable dye diffusion thermal transfer coloring agents may be employed in the ink compositions of the present invention which shall not be restricted to any particular ingredients for this purpose. For example, a first class of dye compositions consists of a group of materials known as "liquid colors" which basically involve sublimable dye diffusion thermal transfer coloring agents (in micro-particulate form) which are already suspended in a selected dispersant system of the type listed above. These "liquid color" materials typically contain about 50–80% by weight water, about 10–20% by weight dye (D2T2 coloring agent), about 5–10% by weight dispersant (either a solid or liquid type as discussed below), and about 5–20% by weight humectant (for inhibiting water evaporation).

Representative, non-limiting examples of these pre-manufactured, ready-to-use liquid color materials are commercially available from many sources including but not limited to BASF of Charlotte, N.C. (USA) under the trademark BAFIXAN. For example, the following representative sublimable dye diffusion thermal transfer coloring agents in the form of ready-to-use "liquid colors" are available under the BAFIXAN trademark, with the C.I. (Color Index) name of the coloring agent in the composition being listed in brackets following the commercial name of the product: (1) BAFIXAN RED BF [C.I. Disperse Red 60]; (2) BAFIXAN YELLOW 3GE [C.I. Disperse Yellow 54]; (3) BAFIXAN BLUE R [C.I. Disperse Blue 326]; and (4) BAFIXAN BLACK BN [a blend of C.I. Disperse Red 60, C.I. Disperse Yellow 54, and C.I. Disperse Blue 79]. As noted above, "C.I." stands for the *Color Index,* Vol. 4, 3r ed., published by The Society of Dyers and Colourists, Yorkshire, England (1971) which is incorporated herein by reference and is a standard text that is well-known in the art. However, as noted above, these materials involve representative examples only with a number of other similar products being suitable for use in the claimed invention. Many other formulations involving the above-listed and other C.I. "disperse" dyes can also be employed.

Another class of ink compositions containing one or more sublimable dye diffusion thermal transfer coloring agents which may be employed in this case involve solid dye materials (e.g. in powder form) that can be combined during ink formulation with a selected liquid or solid dispersing agent, water, and like. Specifically, these materials do not involve "pre-manufactured" liquid dye compositions as previously described in connection with the "liquid colors" listed above. Instead, they are subsequently converted into a liquid dispersion (having the same ingredients and proportions as those designated above in connection with the "liquid colors") immediately before or during ink production. Representative, non-limiting examples of these solid dye compositions (listed by Color Index number, followed by a commercial supplier and product trademark in brackets) are as follows: (1) C.I. Disperse Blue 3 [Keystone Aniline of Chicago, Ill. (USA)—SUBLAPRINT BLUE 70014]; (2) C.I. Disperse Blue 14 [Keystone Aniline—SUBLAPRINT BLUE 70013]; (3) C.I. Disperse Blue 72 [Tricon Colors of Elmwood, N.J. (USA)]; (4) C.I. Disperse Blue 359 [Crompton and Knowles of Charlotte, N.C. (USA)—INTRATHERM BLUE P-1305NT]; (5) C.I. Disperse Red 60 [Crompton and Knowles—INTRATHERM BRILLIANT RED P-1314NT]; and (6) C.I. Disperse Yellow 54 [Crompton and Knowles—INTRATHERM YELLOW P-343NT]. Again, the present invention shall not be restricted to any particular sublimable dye diffusion thermal transfer coloring agents and ink compositions containing the same, with the representative products listed above being provided for example purposes.

In both of the previously-described classes of dye compositions (e.g. "liquid colors" and solid colorant materials), at least one liquid or solid dispersing agent is employed. Many different dispersing agents may be used for this purpose including but not limited to acrylic polymers sold under the trademark JONCRYL by S.C.

Johnson Co. of Racine, Wis. (USA), condensed naphthalene sulfonates sold under the trademark LOMAR by the Henkel Co. of Kankakee, Ill. (USA), and sodium lignosulfonates sold by Lignotech of Rothschild, Wis. (USA). As noted above, the final liquid dye product (in completed dispersion form) in both embodiments will typically include about 50–80% by weight water, about 10–20% by weight dye (D2T2 coloring agent), about 5–10% by weight dispersant, and about 5–20% by weight humectant. Representative humectants include 2-pyrrolidone; 1,5-pentanediol; diethylene glycol; and 2-ethyl-2-hydroxymethyl-1,3-propanediol. However, these values and materials may be varied in accordance with the particular dye compounds under consideration and other factors. Likewise, the completed ink composition in the present case will preferably contain about 2.5–12.5% by weight completed dispersion containing the selected sublimable dye diffusion thermal transfer coloring agent therein (e.g. the selected dye+dispersant materials in combination).

Having described in detail the coloring agents and materials to be employed in the present invention, the other ink ingredients of primary concern will now be discussed. In addition to the coloring agents listed above, the ink composition will also include an ink "vehicle" which is primarily used as a carrier medium for the other components in the completed ink product. The term "vehicle" is typically defined to encompass all of the other ingredients in the completed ink composition aside from the colorant materials. In this regard, many different materials may be employed as the ink vehicle (alone or in combination), with the claimed invention not being limited to any particular compositions for this purpose. A preferred primary ink vehicle component will consist of water, although other compositions may be employed in combination with water including 2-pyrrolidone; ethoxylated glycerol; diethylene glycol; 1,5-pentanediol; N-methyl pyrrolidone; 2-propanol; and 2-ethyl-2-hydroxymethyl-1,3-propanediol. These materials are commercially available from numerous sources including but not limited to Aldrich Chemicals, Inc. of Milwaukee, Wis. (USA). All of these components can be used in various combinations as determined by preliminary pilot studies on the ink compositions of concern. However, in a preferred embodiment of the ink composition listed above which contains about 2.5–12.5% by weight colorant dispersion, the completed ink will include about 87.5–97.5% by weight total combined ink vehicle (e.g. all of the vehicle components in combination). Likewise, the ink composition will typically contain about 50–80% by weight water and about 10–40% by weight organic solvent materials of the type listed above.

Next, the ink composition may include a number of optional ingredients as part of the total ink "vehicle" in varying amounts. For example, an optional biocide may be added to prevent any microbial growth in the final ink product. Exemplary biocides suitable for this purpose include proprietary products sold under the trademarks PROXEL GXL by Imperial Chemical Industries of Manchester, England; UCARCID 250 by Union Carbide of Danbury, Conn. (USA); and NUOSEPT 95 by Huls America, Inc. of Piscataway, N.J. (USA). In a preferred embodiment, if a biocide is used, the final ink composition will contain about 0.05–0.5% by weight biocide, with about 0.30% by weight being preferred.

Finally, one or more optional humectants may be employed in the completed ink product. These materials are designed to inhibit water evaporation as noted above. Representative humectant compositions suitable for this purpose (which may also function as solvents) include but are not limited to 2-pyrrolidone; 1,5-pentanediol; diethylene glycol; and 2-ethyl-2-hydroxymethyl-1,3-propanediol. In a preferred embodiment, the claimed ink composition will include about 5–40% by weight humectant therein (if used). Additional ingredients (e.g. surfactants) may also be present in the ink composition if needed.

The completed ink compositions may be then be used directly in the methods of the present invention. Upon completion, the ink compositions will typically have an average viscosity of about 1.0–5.0 centipoise, with a surface tension of about 30–45 dynes/cm although these values are subject to variation in accordance with the specific materials that are selected to produce the final ink product. The following ink formulations represent non-limiting, specific examples of completed ink products which may be used in the claimed process which include (1) a sublimable dye diffusion thermal transfer colorant; and (2) an ink vehicle:

Example 1

| Ingredient | Amount (% by weight) |
|---|---|
| Sublimable dye diffusion thermal transfer coloring agent (C. I. Disperse Red 60 - [BAFIXAN RED BF]) which includes the above dye + dispersant in "liquid color" form as discussed above. | 7.5 |
| 1,5-pentanediol (solvent/humectant) | 25% |
| Water | 67.5 |

Example 2

| Ingredient | Amount (% by weight) |
|---|---|
| Sublimable dye diffusion thermal transfer coloring agent (Disperse Blue 326 - [BAFIXAN BLUE R]) which includes the above dye + dispersant in "liquid color" form as discussed above. | 12.5 |
| 2-pyrrolidone (solvent) | 8 |
| ethoxylated glycerol[1] (solvent) | 8 |
| polyoxyalkylene polyol[2] (solvent) | 1 |
| Water | 70.5 |

[1]available from Lipo Chemicals, Inc. of Paterson, NJ (USA) under the trademark LIPONIC EG-1
[2]available from the Bayer Corporation of Germany under the trademark MULTRANOL 4012.

As previously noted, the present invention shall not be limited to the representative ink compositions listed above which are provided for example purposes.

D. The Image Printing Process

A representative procedure for generating clear, vivid, and water-fast printed images on a multi-layer substrate 200 having (1) a backing layer 202; and (2) and an ink absorbent layer 212 will now be described. While many different printing systems may be employed to deliver the desired ink composition 174 (FIG. 1) onto the image-receiving substrate 200, the present invention shall be primarily described in connection with thermal inkjet technology. Again, the printed image may either be monochromatic or multi-colored.

Figure 4:
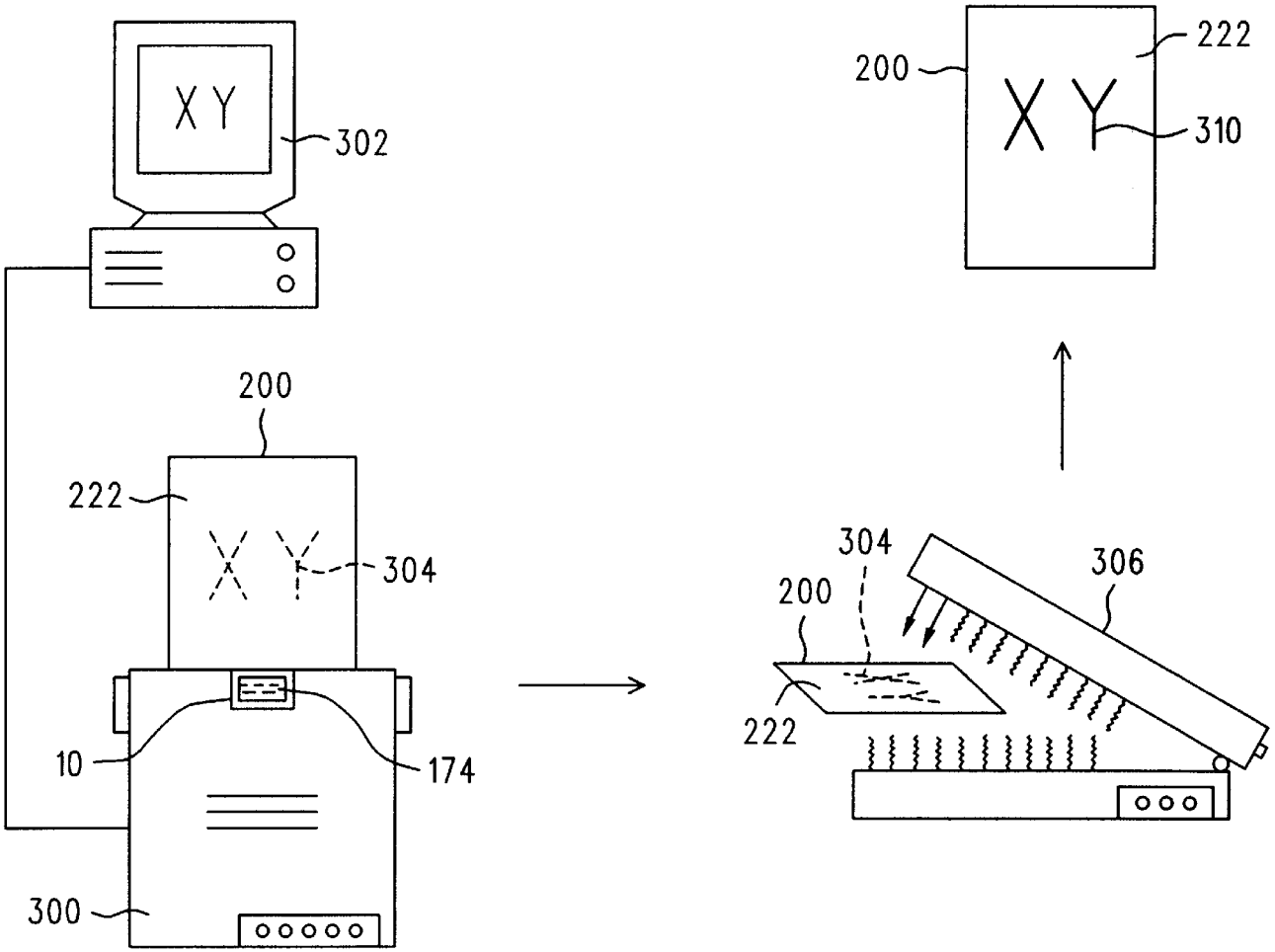
FIG. 4 is a sequential, schematic view of the steps which are used to deliver a printed image to the substrate of FIG. 3 using the materials and processes of the invention.

With reference to FIG. 4, a thermal inkjet printing unit 300 is provided which is used as the printing apparatus in this embodiment. Many different systems may be selected for use in connection with the printing unit 300, including printers manufactured and sold by the Hewlett-Packard Company of Palo Alto, Calif. (USA) under the following product designations: DESKJET 400C, 500C, 540C, 660C, 693C, 820C, 850C, 870C, 1200C, and 1600C. A thermal inkjet cartridge unit (e.g. cartridge 10 illustrated in FIG. 1) is provided within the printing unit 300 which is supplied with the selected ink composition 174. Again, many different cartridge types may be employed in this case which include a housing, a printhead attached to and in fluid communication with the housing, and at least one ink ejector in the printhead (e.g. one or more thin film tantalum-aluminum resistors if thermal inkjet systems are involved). However, in the printing unit 300 associated with this embodiment, a thermal inkjet cartridge is employed, with a number of commercially available cartridge units being suitable this purpose including those produced by the Hewlett-Packard Company of Palo Alto, Calif. (USA) under the following product designations: 51641A, 51645A, 51640C, 51640A, 51629A, and 51649A. As previously noted, the ink composition 174 contains at least one ink vehicle and at least one sublimable dye diffusion thermal transfer coloring agent.

Next, a multi-layer substrate 200 of the type previously discussed is provided and inserted (e.g. placed) into the printing unit 300 with the ink absorbent layer 212 facing upwardly toward the ink cartridge 10. With continued reference to FIG. 4, the printing unit 300 is electrically connected to an image generating apparatus 302 which may involve many different systems selected from the group consisting of a personal computer (e.g. of the type manufactured by the Hewlett-Packard Company of Palo Alto, Calif. (USA) under the trademark "PAVILION®"), a scanner unit (of the variety sold by the Hewlett-Packard Company of Palo Alto, Calif. (USA) under the trademark "SCANJET®") or both. In this regard, the claimed process shall not be restricted to any particular image generation device or protocol.

Next, the image generating apparatus 302 and the printing unit 300 are cooperatively activated in order to deliver a desired intermediate printed image 304 onto the substrate 200 (shown in phantom lines in FIG. 4). Both the image generating apparatus 302 and the printing unit 300 are used to control the operation of the ink cartridge 10. The printing process is initiated by activation of the ink ejectors (e.g. thin-film resistors 86) in the printhead 80 of the ink cartridge 10. The term "activation" shall again involve a process in which the thin-film resistors 86 of the ink cartridge 10 are directed by the printing unit 300 to deliver the ink composition 174 from the compartment 30 to the top surface 222 of the substrate 200 (which also functions as the upper surface 214 of the ink absorbent layer 212). This is specifically accomplished by selectively energizing the thin film resistors 86 in the printhead 80 of the cartridge 10 (FIG. 2). As a result, ink residing within the vaporization chambers 160 beneath the orifice plate 104 is thermally excited and expelled outwardly through the ink ejection orifices 124 in the plate 104 onto the image-receiving substrate 200. In this manner, the cartridge 10 may be used to deliver an intermediate printed image 304 to the substrate 200 using the ink composition 174.

Figure 5:
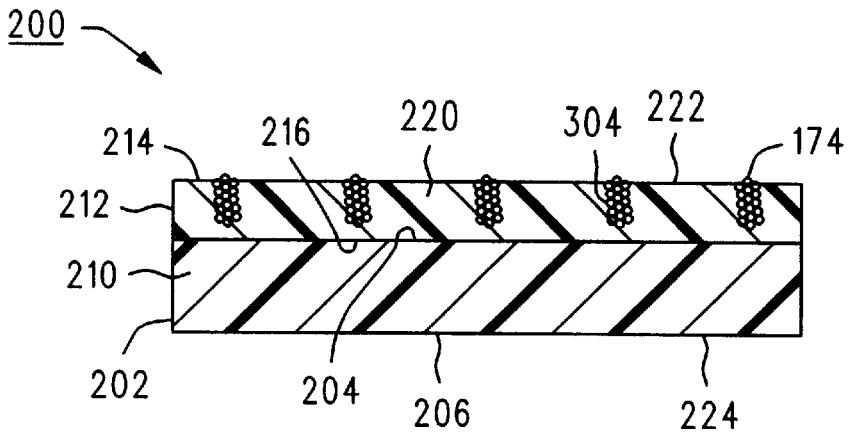
FIG. 5 is a cross-sectional, schematic view of the substrate of FIG. 3 after delivery of the ink composition to the substrate in the process of FIG. 4 and before the printed substrate is heated.

Delivery of the ink composition 174 to the top surface 222 of the substrate 200 (e.g. the upper surface 214 of the ink absorbent layer 212) as described above causes the ink composition 174 to be absorbed entirely or least partially into the interior region 220 of the ink absorbent layer 212. Whether the ink composition 174 is entirely absorbed into the ink absorbent layer 212 or only partially absorbed (with some of the ink composition 174 remaining adsorbed on the upper surface 214 of the ink absorbent layer 212), both of these interactions between the ink composition 174 and the ink absorbent layer 212 shall be considered equivalent in function, purpose, and final result. As a result, most or all of the selected ink composition 174 is temporarily retained within the interior region 220 of the ink absorbent layer 212 as schematically illustrated in FIG. 5. This situation occurs in accordance with the absorbent and micro-porous character of the materials used to produce the ink absorbent layer 212 as noted above.

At this stage, the intermediate printed image 304 is characterized as "intermediate" since the sublimable dye diffusion thermal transfer coloring agents in the ink composition 174 have not yet been sublimed. This results in a printed image which, while sharp in "edge acuity", has non-vivid color characteristics due to the unsublimed, particulate nature of the coloring agents at this stage in the claimed method.

The printed substrate 200 is now ready for the next step in the production process. With continued reference to FIG. 4, the substrate 200 is heated to a temperature sufficient to cause (1) sublimation of the sublimable dye diffusion thermal transfer coloring agents in the ink composition 174; and (2) diffusion/absorption of these materials from the ink absorbent layer 212 into the interior region 210 of the backing layer 202. In a preferred and non-limiting embodiment, this step is achieved by heating the entire substrate 200 to a temperature of about 180–220° C. over a time period of about 5–30 seconds. However, these parameters may again be varied as needed in accordance with the particular ink compositions being employed and the specific materials used in connection with the substrate 200 as determined by routine preliminary tests.

During the heating process described above, it is preferred that the top surface 222 of the image-receiving substrate 200 (e.g. the upper surface 214 of the ink absorbent layer 212) be physically unattached to any other layers of material (e.g. coating compositions) during the application of heat. In particular, as shown in FIG. 4, the top surface 222 of the substrate 200 is not coated with any additional layers of material, with the lack of such a "coating" or covering composition involving a situation in which the top surface 222 of the substrate 200 does not have any additional materials attached thereto by physical, chemical, or electrostatic means. This qualification excludes temporary cover members or release sheets which are not "attached" to the substrate 200 but are merely placed in position thereon for a short time period and then removed to accomplish a variety of goals including a reduction in cleaning and maintenance requirements associated with the heating apparatus (discussed below.) This lack of a required coating layer on the top surface 222 of the substrate 200 in a preferred embodiment allows rapid and uniform heat penetration through the multiple layers 202, 212 of the substrate 200 and likewise reduces the overall complexity of the claimed process.

This step of the present invention (which involves heating the substrate 200) is accomplished using a heating apparatus 306 schematically shown in FIG. 4. Many different systems may be employed as the heating apparatus 306, with the claimed invention not being restricted to any particular devices for this purpose. For example, in a representative embodiment, a conventional heat press may function as the heating apparatus 306. A commercially available heat press system suitable for this purpose is available from the HIX Corporation of Pittsburg, Kans. (USA)—model no. N-800. When this type of heat press system is used, an optional additional step would involve the placement of a temporary film-type cover sheet (e.g. made of polytetrafluoroethylene [Teflon®]—not shown) on the top surface 222 of the substrate 200 during the heat-pressing process. Since the use of a heat press necessarily involves direct physical contact between the substrate 200 and the plate members of the heat press unit, the use of an optional cover sheet will protect the top surface 222 of the substrate 200 from dirt, physical abrasion/damage, and excessive (uneven) heat concentration. Likewise, the cover sheet will keep the heat press clean. The decision to use a cover sheet may be reached in accordance with one or more preliminary tests on the substrates 200 being printed and the particular type of heating apparatus 306 under consideration.

A number of other heating systems may also be used as the heating apparatus 306 including (1) a continuous web transfer press of conventional design which may be obtained from, for example, GBC Pro-Tech of DeForest, Wis. (USA); (2) conventional infra-red illumination/heating systems; and (3) standard resistance or microwave type heating units (ovens). Thus, as noted above, the claimed process shall not be restricted to any particular heating devices or systems in connection with the heating apparatus 306. It should also be noted that a more specialized, self-contained heating system will be discussed below in an alternative embodiment of the invention (see FIG. 7).

While not required in the claimed invention, a further optional step involves the application of pressure in a uniform manner to the substrate 200 (e.g. to the top surface 222, the bottom surface 224, or both surfaces 222, 224 of the substrate 200). Pressure application optimally occurs during the heating process. This additional step is particularly appropriate when a heat press system of the type described above is used as the heating apparatus 306, with the application of pressure to the substrate 200 further enhancing the dye diffusion/affixation process. Conventional heat press systems as shown in FIG. 4 operate by pressing the printed substrate 200 between dual plate-like press members. As a result of this "pressing" process, pressure is uniformly applied to both the top and bottom surfaces 222, 224 of the substrate 200 during the application of heat. Even if other heating systems are employed in the claimed method, pressure may still be applied to the substrate 200 using any known or conventional press system or pressure-exerting device. Regardless of which approach is selected to deliver pressure to the substrate 200, efficient results are achieved when pressure levels are applied to the substrate 200 (e.g. to the top surface 222, bottom surface 224 or both surfaces 222, 224) within a range of about 3–40 psi during or immediately after heating.

The need to apply pressure to the substrate 200 (as well as the particular pressure levels of interest) may again be determined in accordance with preliminary studies on the materials being processed, with particular emphasis on the compositions that are selected for use in the ink absorbent layer 212 and backing layer 202 of the substrate 200. Accordingly, the claimed invention shall not be restricted to any particular pressure levels (or the application of pressure as a general concept).

Figure 6:
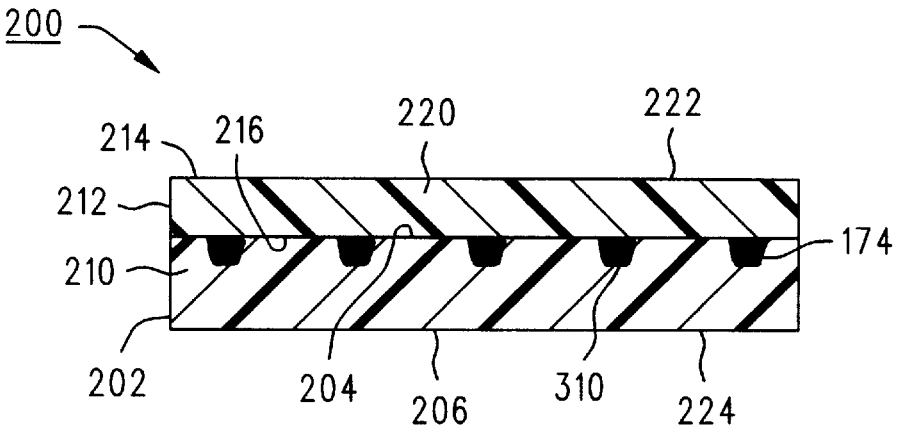
FIG. 6 is a cross-sectional, schematic view of the substrate of FIG. 5 after it is heated in accordance with the process of FIG. 4.

As the substrate 200 is heated within the heating apparatus 306 in accordance with the parameters listed above (along with the exertion of pressure if needed or desired), the sublimable dye diffusion thermal transfer coloring agent in the ink composition 174 (which was present in micro-particulate, solid form prior to heating) undergoes sublimation within the substrate 200. The sublimation process involves a change in the physical state of the coloring agent which is converted directly from a solid state to a gas. As a result of this step, the sublimed, gaseous coloring agents diffuse/absorb directly from the ink absorbent layer 212 into the interior region 210 of the backing layer 202 as illustrated schematically in FIG. 6. This process in which the coloring agents are able to diffuse directly into the backing layer 202 of the substrate 200 is a unique feature of the present invention which is accomplished as a result of (1) the particular materials used in ink composition which contains one or more sublimable dye diffusion thermal transfer coloring agents; and (2) the specific physical characteristics of the materials that are used to produce the backing layer 202 which is sufficiently permeable to enable passage of the sublimed coloring agents directly into the interior region 210 of the layer 202. In particular, the absorptive and capillary characteristics of the materials used to produce the backing layer 202 (discussed above) enable the sublimed coloring agents to be effectively "drawn" into the interior region 210 of the layer 202. As a result, the sublimed coloring agents are retained within the interior region 210 of the backing layer 202 and (because of the chemical conversion process described above) now have a different visual appearance compared with the "dull" character of the intermediate printed image 304. In particular, the claimed sublimation process enables the formation of a clear, vivid, and water-fast final printed image 310. The final printed image 310 is maintained within the interior region 210 of the backing layer 202 which further enhances the water-fast character of the image 310 and is a substantial departure from prior systems. In view of the unique procedural steps described above and the numerous benefits provided by the claimed process, the present invention represents an important advance in printing technology. Specifically, the specialized method shown in FIG. 4 (which involves a sequential diffusion procedure in which sublimable coloring agents are first passed into the ink absorbent layer 212 and then into the backing layer 202 of the substrate 200 during/after sublimation) constitutes an important development which is useful in many different applications.

With continued reference to FIG. 4, the substrate 200 with the final printed image 310 thereon is then removed from the heating apparatus 306 and used as desired. Again, it is important to emphasize that the present invention may involve many different coloring agents, substrate materials/sizes, and other factors which are determined in accordance with the intended use of the final printed product.

Figure 7:
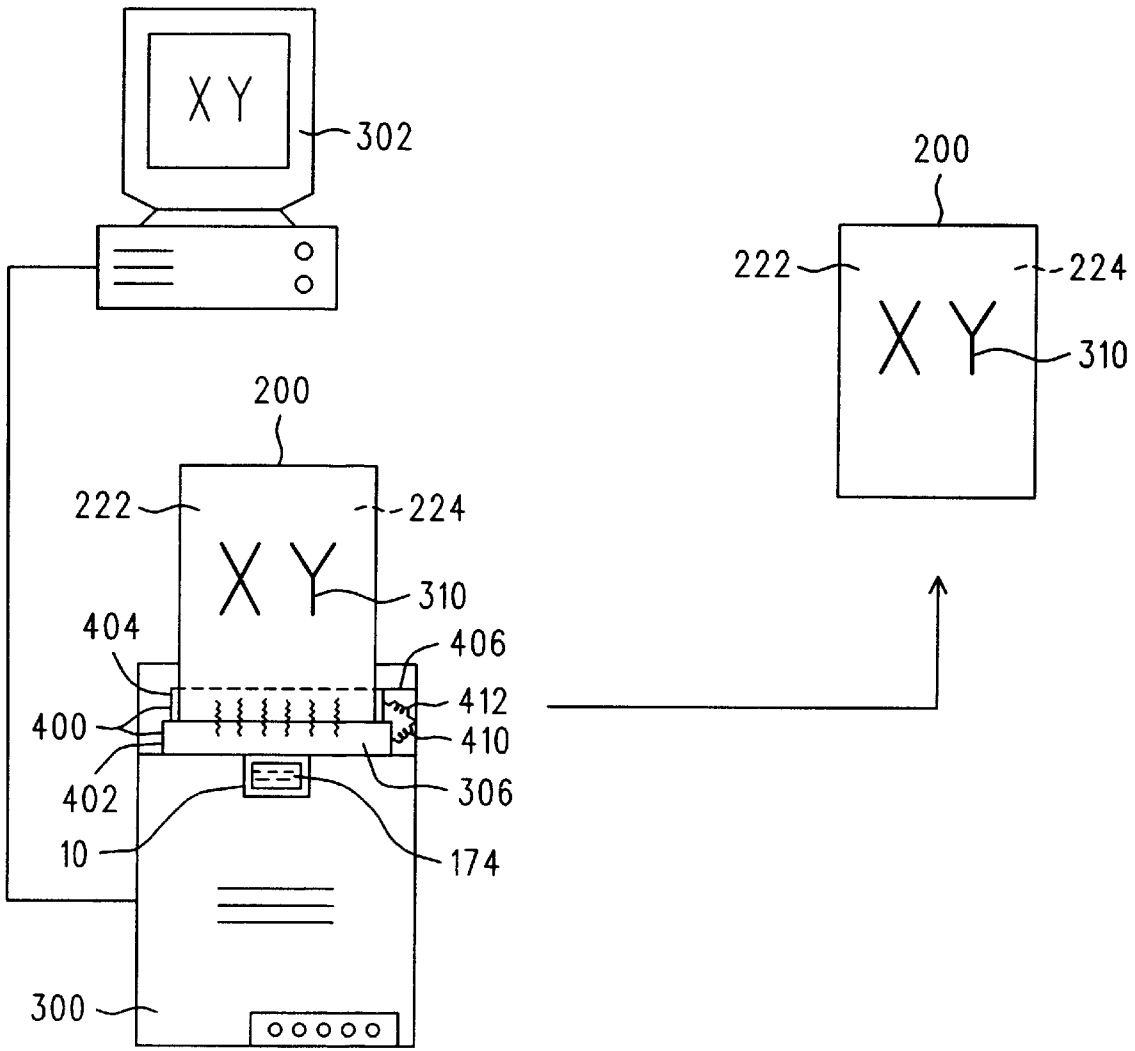
FIG. 7 is a sequential, schematic view of the steps which are used to deliver a printed image to the substrate of FIG. 3 in an alternative embodiment of the invention which involves a different heating method.

An alternative embodiment of the process and system illustrated in FIG. 4 is schematically shown in FIG. 7. All of the steps, parameters, materials, and chemical compositions associated with the embodiment of FIG. 4 are equally applicable to the embodiment of FIG. 7 unless otherwise indicated below. Reference numbers in FIG. 4 which correspond with those in FIG. 7 signify parts, components, and elements that are common to the structures and process steps in both embodiments. These common elements are discussed above in connection with the system of FIG. 4, with the discussion of these items being incorporated by reference relative to the embodiment of FIG. 7.

As illustrated in FIG. 7, the substrate 200 and ink composition 174 are the same as those discussed above in connection with FIG. 4. However, the manner in which the substrate 200 is heated (and subjected to pressure) is different compared with the embodiment of FIG. 4. Specifically, with reference to FIG. 7, the printer unit 300 includes a heating/pressure-exerting apparatus therein (e.g. with the term "therein" involving a situation in which this subsystem is either placed inside the printer unit 300 or is externally attached to the printer unit 300). This embodiment shall not be restricted to any type of integral heating system, provided that the printer unit 300 incorporates one or more heat-generating subsystems which deliver heat to the substrate 200 after or during the printing process.

To heat the substrate 200 at the temperature levels listed above (about 180–220° C.) over the preferred time period of approximately 5–30 seconds in the embodiment of FIG. 7, the printer unit 300 includes at least one heating member 400 inside the printer unit 300 or otherwise attached thereto. The heating member 400 (which generally functions as the heating apparatus 306 in this embodiment) may involve one or more heated "pinch"-type rollers, platens, rods, bars, plates, and the like, with the claimed invention not being restricted to any particular structural components for this purpose. The heating member 400 is designed to come in direct physical contact with the top surface 222, the bottom surface 224, or both surfaces 222, 224 of the substrate 200 after or during the printing stage of the claimed process. As a result, the necessary amount of heat may be efficiently applied to the substrate 200 (with the exact heating time and temperature levels being controlled by the delivery speed of the printing unit 300, namely, the rate at which the substrate 200 is ejected from the printing unit 300 as determined by preliminary tests.) Operation of the heating member 400 and printer unit 300 may be adjusted as needed to ensure that sufficient heating of the substrate 200 for the necessary time period takes place, with these parameters being subject to variation in accordance with many factors including the materials that are used in the ink composition 174 and substrate 200. Likewise, the exertion of pressure against the substrate 200 at the levels listed above may be accomplished by adjustment of the tension associated with the heating member 400 as it pushes against the substrate 200. By placing the substrate 200 in contact with the heating member 400 in the foregoing manner, a stable, vivid, and water-fast printed image may be created on the substrate 200 from the ink composition 174.

In the specific, non-limiting embodiment of FIG. 7, the heating member 400 consists of dual heated metallic rollers 402,404 which include one or more electrical resistive-type heating elements therein. The roller 402 contacts the top surface 222 of the substrate 200 (e.g. the upper surface 214 of the ink absorbent layer 212), with the roller 404 contacting the bottom surface 224 of the substrate 200 (e.g. the lower surface 206 of the backing layer 202). Proper and desired pressure levels within the preferred range listed above are maintained through the use of a spring-biased tensioning system 406 of conventional design (schematically illustrated in FIG. 7) which is attached to the rollers 402, 404. This particular system basically involves one or more spring elements 410, 412 which urge the rollers 402, 404 against the substrate 200. However, the present invention shall not be restricted to the specific components described above which are provided for example purposes only. Either one or multiple heating members 400 may be used in connection the substrate 200 as needed and desired. While the "pinch roller" embodiment of FIG. 7 is preferred and provides ideal results, the heating member 400 positioned within the printer unit 300 may simply involve an electrically-heated bar member or plate which is placed in direct contact with the top surface 222 of the substrate 200 as it passes out of the printer unit 300. Thus, many variations are possible in connection with the embodiment of FIG. 7 provided that they encompass the basic process described above, namely, a sequential diffusion procedure in which sublimable coloring agents are first passed into the ink absorbent layer 212 and then into the backing layer 202 of the substrate 200 by the application of heat from the heating member 400. This particular system eliminates the need for a heating apparatus 306 which is located outside of the printer unit 300. However, the result of this embodiment is the same as that provided by the embodiment of FIG. 4, namely, the production of a substrate 200 having a final printed image 310 thereon which is clear, vivid, and water-fast.

As previously noted, the present invention provides numerous benefits and advantages including: (1) the rapid printing of clear and vivid ("high chroma") images with a minimal amount of equipment and process steps; (2) enhanced image water-fastness and stability; (3) a minimal level of complexity and required equipment which facilitates at-home use by consumers; (4) the ability to use thermal inkjet technology (or other comparable printing systems) to generate high-resolution multi-color images which are characterized by improved stability levels; and (5) the ability to accomplish these goals using low-cost materials and equipment. Accordingly, the claimed process constitutes an important technical development with widespread applications for both business and in-home use. Having herein set forth preferred embodiments of the invention, it is anticipated that suitable modifications may be made thereto by individuals skilled in the art which nonetheless remain within the scope of the invention. For example, the invention shall not be limited to any particular ink compositions, heating equipment, and material layers used to manufacture the image-receiving substrate within the general parameters and guidelines set forth above. In this regard, the present invention shall only be construed in accordance with the following claims:

The invention that is claimed is:

1. A method for applying a water-fast printed image to a substrate using water-based liquid ink compositions comprising:

providing an image-receiving substrate comprising a backing layer and an uppermost ink absorbent layer positioned on said backing layer, said backing layer further comprising an interior region therein, said ink absorbent layer being comprised of at least one hydrophilic composition that is able to absorb water-based liquid ink compositions therein;

providing a water-based liquid ink composition comprising at least one sublimable coloring agent which is able, upon sublimation thereof, to diffuse into said interior region of said backing layer, said ink composition further comprising an ink vehicle comprised of water, said backing layer being comprised of a material which will allow said coloring agent in said ink composition to diffuse into said interior region of said backing layer during sublimation of said coloring agent;

delivering said water-based liquid ink composition to said ink absorbent layer of said image-receiving substrate, said ink absorbent layer being able to absorb said water-based liquid ink composition therein; and applying heat to said image-receiving substrate in an amount sufficient to cause sublimation of said coloring agent in said water-based liquid ink composition and diffusion of said coloring agent from said ink absorbent layer into said interior region of said backing layer so that said coloring agent is retained therein, said applying of said heat to said substrate forming a stable and water-fast printed image from said water-based liquid ink composition.

2. A method for applying a water-fast printed image to a substrate using water-based liquid ink compositions comprising:

providing an image-receiving substrate comprising a backing layer and an uppermost ink absorbent layer positioned on said backing layer, said backing layer further comprising an interior region therein, said ink absorbent layer being comprised of at least one hydrophilic composition that is able to absorb water-based liquid ink compositions therein, said hydrophilic composition being selected from the group consisting of polyvinyl alcohol, polyacrylamide, polyvinyl acetate, polyvinyl pyrrolidone, polyvinylidene chloride, polyacrylate, and methyl cellulose;

providing a water-based liquid ink composition comprising at least one sublimable coloring agent which is able, upon sublimation thereof, to diffuse into said interior region of said backing layer, said ink composition further comprising an ink vehicle comprised of water, said backing layer being comprised of a material which will allow said coloring agent in said ink composition to diffuse into said interior region of said backing layer during sublimation of said coloring agent;

delivering said water-based liquid ink composition to said ink absorbent layer of said image-receiving substrate, said ink absorbent layer being able to absorb said water-based liquid ink composition therein; and applying heat to said image-receiving substrate in an amount sufficient to cause sublimation of said coloring agent in said water-based liquid ink composition and diffusion of said coloring agent from said ink absorbent layer into said interior region of said backing layer so that said coloring agent is retained therein, said applying of said heat to said substrate forming a stable and water-fast printed image from said water-based liquid ink composition.

3. A method for applying a water-fast printed image to a substrate using water-based liquid ink compositions comprising:

providing an image-receiving substrate comprising a backing layer and an uppermost ink absorbent layer positioned on said backing layer, said backing layer further comprising an interior region therein, said ink absorbent layer being comprised of at least one hydrophilic composition that is able to absorb water-based liquid ink compositions therein, said hydrophilic composition being selected from the group consisting of polyvinyl alcohol, polyacrylamide, polyvinyl acetate, polyvinyl pyrrolidone, polyvinylidene chloride, polyacrylate, and methyl cellulose providing a water-based liquid ink composition comprising at least one sublimable coloring agent which is able, upon sublimation thereof, to diffuse into said interior region of said backing layer, said ink composition further comprising an ink vehicle comprised of water, said backing layer being comprised of a material which will allow said coloring agent in said ink composition to diffuse into said interior region of said backing layer during sublimation of said coloring agent, said material being selected from the group consisting of at least one polyester composition, polyethylene terephthalate, at least one polycarbonate composition, at least one acrylic composition, and acrylonitrile butadiene styrene terpolymer;

delivering said water-based liquid ink composition to said ink absorbent layer of said image-receiving substrate, said ink absorbent layer being able to absorb said water-based liquid ink composition therein;

heating said image-receiving substrate to a temperature of about 180–220° C. for a time period of about 5–30 seconds in order to cause sublimation of said coloring agent in said water-based liquid ink composition and diffusion of said coloring agent from said ink absorbent layer into said interior region of said backing layer so that said coloring agent is retained therein; and applying pressure to said image-receiving substrate at a level of about 3–40 psi during said heating thereof, said heating of said substrate and said applying of said pressure thereto forming a stable and water-fast printed image from said water-based liquid ink composition.

* * * * *